US009998842B2

(12) United States Patent
Nishidate

(10) Patent No.: US 9,998,842 B2
(45) Date of Patent: Jun. 12, 2018

(54) FABRICATION METHOD OF ACOUSTIC WAVE DEVICE

(71) Applicant: TAIYO YUDEN CO., LTD., Tokyo (JP)

(72) Inventor: Tooru Nishidate, Kanagawa (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 434 days.

(21) Appl. No.: 13/715,030

(22) Filed: Dec. 14, 2012

(65) Prior Publication Data

US 2013/0167340 A1 Jul. 4, 2013

(30) Foreign Application Priority Data

Dec. 28, 2011 (JP) ..... 2011-288729

(51) Int. Cl.
*H04R 31/00* (2006.01)
*H04R 17/00* (2006.01)

(52) U.S. Cl.
CPC ..... *H04R 31/00* (2013.01); *H04R 17/00* (2013.01); *Y10T 29/42* (2015.01)

(58) Field of Classification Search
CPC ..... Y10T 29/42; H01L 41/338; H04R 31/006; H04R 31/00; H04R 17/00; H03H 3/08
USPC ..... 29/25.35; 310/311, 323 R
See application file for complete search history.

(56) References Cited

U.S. PATENT DOCUMENTS 5,758,398 A * 6/1998 Rijnbeek ..... B23K 26/1476 29/25.42
5,759,753 A * 6/1998 Namba ..... H03H 3/02 438/456
5,875,531 A * 3/1999 Nellissen ..... H01G 4/306 29/25.35
5,937,493 A * 8/1999 Nellissen ..... H01G 4/306 29/25.35
6,070,310 A * 6/2000 Ito ..... B41J 2/14209 29/847
7,005,777 B2 * 2/2006 Wright ..... H01L 41/338 310/328
2002/0022345 A1 * 2/2002 Sakaguchi ..... H03H 3/08 438/465

(Continued)

FOREIGN PATENT DOCUMENTS

JP S61-105106 A 5/1986
JP 2001-345658 A 12/2001

(Continued)

OTHER PUBLICATIONS

Japanese Office Action dated Nov. 24, 2015, in a counterpart Japanese patent application No. 2011-288729.

*Primary Examiner* — Peter DungBa Vo
*Assistant Examiner* — Kaying Kue
(74) *Attorney, Agent, or Firm* — Chen Yoshimura LLP

(57) ABSTRACT

A fabrication method of an acoustic wave device includes: forming a metal layer between regions that are located on a piezoelectric substrate and in which acoustic wave chips are to be formed, at least a part of a region of the metal layer extending to an extension direction of a dicing line for separating the acoustic wave chips; and scanning the dicing line of the piezoelectric substrate by a laser beam so that the at least a part of the region of the metal layer is not irradiated with the laser beam.

10 Claims, 12 Drawing Sheets

(56) References Cited

U.S. PATENT DOCUMENTS

| | | | | |
|---|---|---|---|---|
| 2004/0251784 | A1* | 12/2004 | Kuniyasu | B06B 1/064 310/328 |
| 2007/0001550 | A1* | 1/2007 | Palanduz | F04D 33/00 310/328 |
| 2007/0007863 | A1* | 1/2007 | Mohr, III | B06B 1/064 310/365 |
| 2009/0212399 | A1 | 8/2009 | Kaneda et al. | |
| 2011/0020585 | A1* | 1/2011 | Steinfeldt | C04B 41/4505 428/70 |
| 2012/0229002 | A1* | 9/2012 | Takahashi | H03H 9/1021 310/344 |

FOREIGN PATENT DOCUMENTS

| | | | |
|---|---|---|---|
| JP | 2008-100258 | A | 5/2008 |
| JP | 2009-206183 | A | 9/2009 |
| JP | 2010-182901 | A | 8/2010 |

* cited by examiner

FABRICATION METHOD OF ACOUSTIC WAVE DEVICE

CROSS-REFERENCE TO RELATED APPLICATION

This application is based upon and claims the benefit of priority of the prior Japanese Patent Application No. 2011-288729, filed on Dec. 28, 2011, the entire contents of which are incorporated herein by reference.

FIELD

A certain aspect of the present invention relates to a fabrication method of an acoustic wave device, and in particular, to a fabrication method of an acoustic wave device including a step of irradiating a piezoelectric substrate with a laser beam for example.

BACKGROUND

Acoustic wave devices using acoustic waves are small and light, can obtain high attenuation against signals outside a given frequency band, and thus are used as a filter for wireless devices such as mobile phone terminals. The acoustic wave device includes an electrode such as an IDT (Interdigital Transducer) formed on a piezoelectric substrate.

There has been known irradiating a piezoelectric substrate with a laser beam to separate acoustic wave chips formed on the piezoelectric substrate into individual ones. For example, there is disclosed a laser processing equipment that irradiates a wafer with a laser beam in Japanese Patent Application Publication No. 2008-100258. There is disclosed irradiating a piezoelectric substrate with a laser beam to dice the piezoelectric substrate wafer in Japanese Patent Application Publication No. 2001-345658. There is disclosed a method of bonding a semiconductor wafer to a tape and then dicing the semiconductor wafer in Japanese Patent Application Publication No. 2010-182901.

When a piezoelectric substrate is irradiated with a laser beam, debris is easily formed if a metal layer formed on the piezoelectric substrate is irradiated with the laser beam. Scattering of conductive debris on electrodes formed on the piezoelectric substrate causes short circuit between the electrodes, or causes a change in characteristics of the acoustic wave device.

SUMMARY OF THE INVENTION

According to an aspect of the present invention, there is provided a fabrication method of an acoustic wave device including: forming a metal layer between regions that are located on a piezoelectric substrate and in which acoustic wave chips are to be formed, at least a part of a region of the metal layer extending to an extension direction of a dicing line for separating the acoustic wave chips; and scanning the dicing line of the piezoelectric substrate by a laser beam so that the at least a part of the region of the metal layer is not irradiated with the laser beam.

DETAILED DESCRIPTION

Figure 1A:
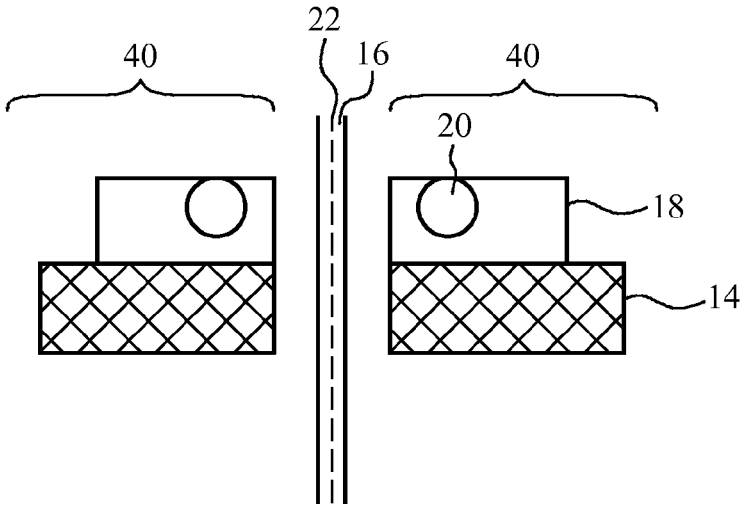
FIG. 1A and FIG. 1B are a plain view and a cross-sectional view, respectively, illustrating a part of a fabrication process of an acoustic wave device in accordance with a comparative example.
Figure 1B:
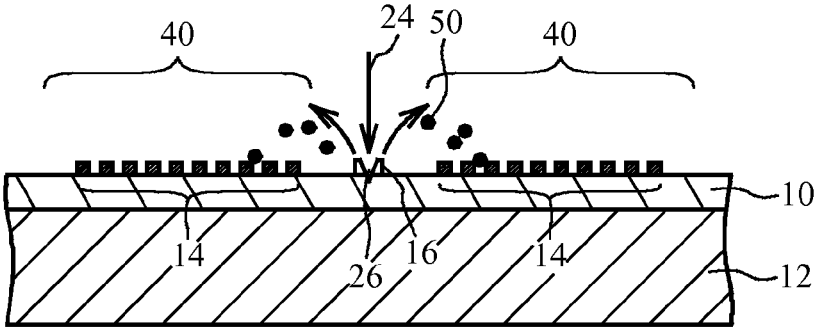

A description will be first given of a comparative example. FIG. 1A and FIG. 1B are a plain view and a cross-sectional view, respectively, illustrating a part of a fabrication process of an acoustic wave device in accordance with the comparative example. Here, the cross-sectional view illustrates electrode fingers of an IDT and the like, and the plain view illustrates the IDT with a rectangle. Referring to FIG. 1A and FIG. 1B, a piezoelectric substrate 10 is bonded on a sapphire substrate 12. Regions 40 in which acoustic wave chips are to be formed are formed on the piezoelectric substrate 10. Electrodes 14 are formed on the piezoelectric substrate 10 in the regions 40. The electrode 14 is an IDT for example. The electrodes 14 are electrically connected to bumps 20 by wirings 18.

A metal layer 16 is formed on the piezoelectric substrate 10 between the regions 40. Dicing lines 22 are lines for dividing the piezoelectric substrate 10 into individual acoustic wave chips. The metal layer 16 extends to extension directions of the dicing lines 22. The metal layer 16 prevents the electrodes 14 from being damaged due to concentration of electric charge, which is generated by a stress applied to the piezoelectric substrate 10, in the electrodes 14 during the fabrication process of the acoustic wave device. The metal layer 16 formed along the dicing lines 22 allows the electric charge generated by the piezoelectric effect to escape. In the comparative example, the dicing lines 22 are located in the metal layer 16.

As illustrated in FIG. 1B, the dicing lines 22 are irradiated with a laser beam 24, and scanned by the laser beam 24. This forms grooves 26 along the dicing lines 22 in the piezoelectric substrate 10. The piezoelectric substrate 10 is divided using these grooves 26. However, if the metal layer 16 is irradiated with the laser beam 24, a number of conductive debris 50 scatter. If the debris adheres on the electrodes 14, short circuit occurs between the electrodes 14. The debris may modulate the acoustic wave, and change a frequency characteristic of the acoustic wave device. Furthermore, depths of the grooves 26 become small because the grooves 26 are formed through the metal layer 16. In addition, property changed regions resulting from the irradiation of the laser beam 24 are hard to be formed in the piezoelectric substrate 10 and the sapphire substrate 12. This makes it difficult to cut the piezoelectric substrate 10 along the dicing lines 22.

For example, when an insulating film is formed on the electrodes 14 as a protective film, the debris 50 adheres on the insulating film. Even in this case, if the insulating film is thin, the debris causes short circuit between the electrodes 14. In addition, the debris causes a change in the frequency characteristic of the acoustic wave device.

Hereinafter, a description will be given of embodiments solving the above described problem.

First Embodiment

Figure 2:
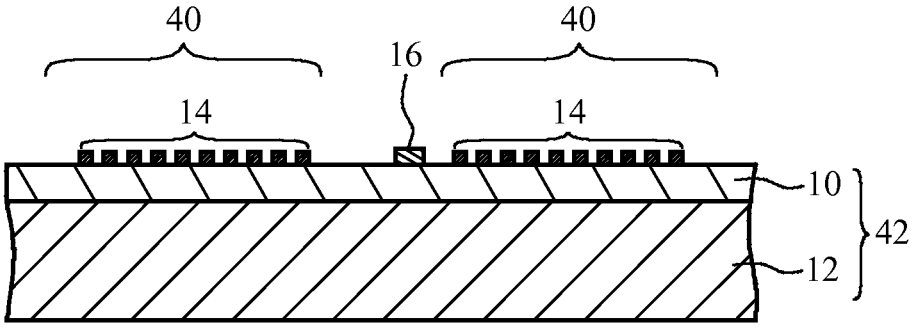
FIG. 2 is a cross-sectional view illustrating a fabrication method of an acoustic wave device in accordance with a first embodiment.

FIG. 2 is a cross-sectional view illustrating a fabrication method of an acoustic wave device in accordance with a first embodiment. Referring to FIG. 2, a wafer 42 includes the sapphire substrate 12 and the piezoelectric substrate 10. A lithium tantalate or lithium niobate substrate is used for the piezoelectric substrate 10, for example. A film thickness of the piezoelectric substrate 10 is 30 μm to 40 μm, and a film thickness of the sapphire substrate 12 is 250 μm to 300 μm, for example. The piezoelectric substrate 10 is bonded on the sapphire substrate 12. The electrodes 14 are formed in the regions 40 that are located on the piezoelectric substrate 10 and in which acoustic wave chips are to be formed. The metal layer 16 is formed so as to be located between the regions 40. The electrodes 14 and the metal layer 16 are made of a metal mainly including aluminum, copper, or the like. Film thicknesses of the electrodes 14 and the metal layer 16 are less than or equal to 1 μm, and are 200 nm to 400 nm, for example. The electrodes 14 and the metal layer 16 may be formed simultaneously, or may be formed separately. The electrode 14 is an IDT for example. The electrode 14 may include a reflector. FIG. 2 illustrates electrode fingers of the IDT as the electrode 14. An insulating film may be formed on the electrodes 14 and the metal layer 16 as a protective film.

Figure 3:
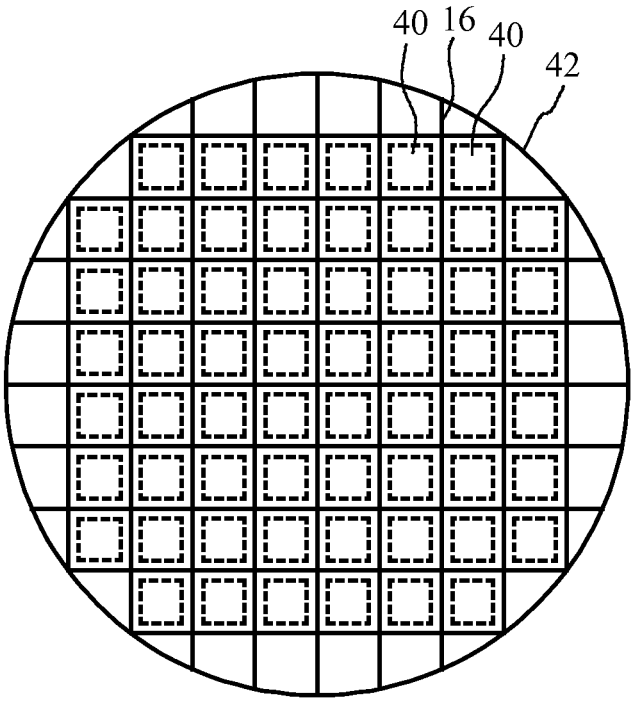
FIG. 3 is a plain view of a wafer on which a metal layer is formed.

FIG. 3 is a plain view of a wafer on which the metal layer is formed. Referring to FIG. 3, the wafer 42 is a wafer formed by bonding the sapphire substrate 12 and the piezoelectric substrate 10 as illustrated in FIG. 2. The regions 40 in which acoustic wave chips are to be formed are formed in a matrix shape on the wafer 42. The metal layer 16 is formed so as to be located between the regions 40. The metal layer 16 continuously extends to an edge of the wafer 42. For example, the metal layer 16 is electrically connected to a back surface of the wafer 42 at the edge of the wafer 42. This enables to connect the metal layer 16 to ground during the fabrication process of the acoustic wave device by processing each fabrication step with the wafer 42 being attached to a stage of a fabrication device. Thus, the electrodes 14 are prevented from being damaged during the fabrication process of the acoustic wave device.

Figure 4:
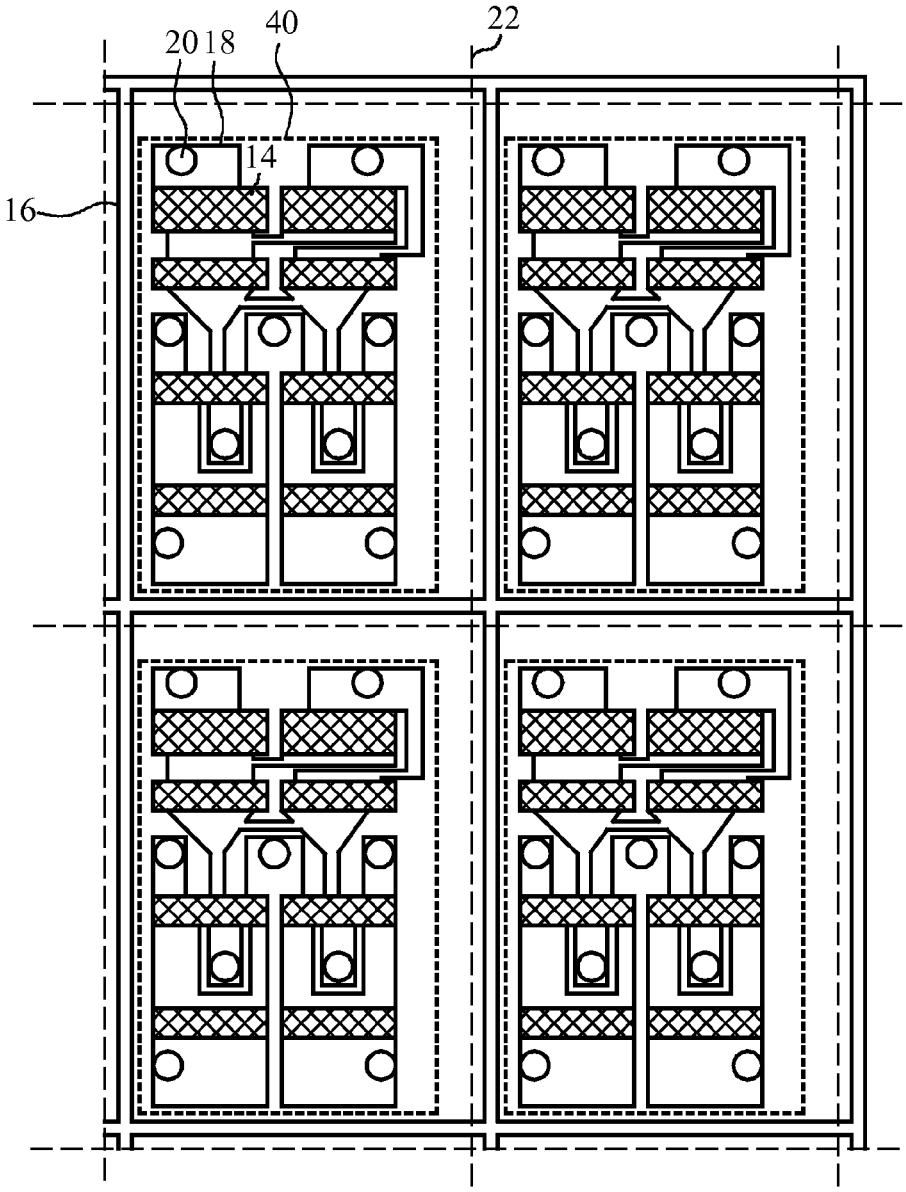
FIG. 4 is a plain view enlarging an upper surface of the wafer of the first embodiment.

FIG. 4 is a plain view enlarging an upper surface of the wafer of the first embodiment. Referring to FIG. 4, the electrodes 14, the wirings 18 and the bumps 20 are formed in each of the regions 40. The electrode 14 is an IDT for example. The wirings 18 electrically interconnect the electrodes 14, and electrically connect the electrodes 14 and the bumps 20. The bump 20 is an Au stud bump for example, and is a terminal for providing external connection to the acoustic wave device. The metal layer 16 extends to the extension directions of the dicing lines 22, but does not overlap with the dicing lines 22 in its extension directions.

Figure 5A:
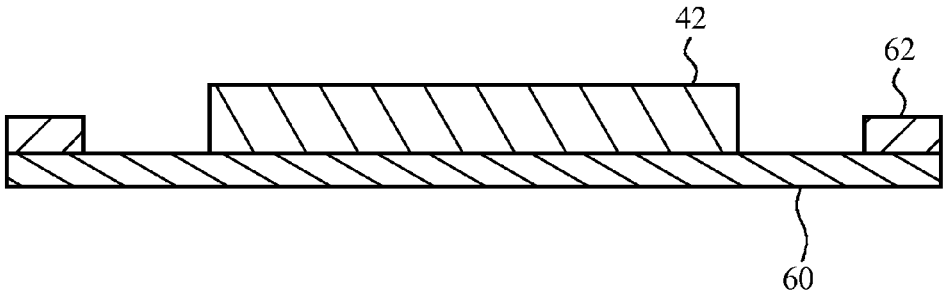
FIG. 5A and FIG. 5B are cross-sectional views illustrating the fabrication method of the acoustic wave device in accordance with the first embodiment.
Figure 5B:
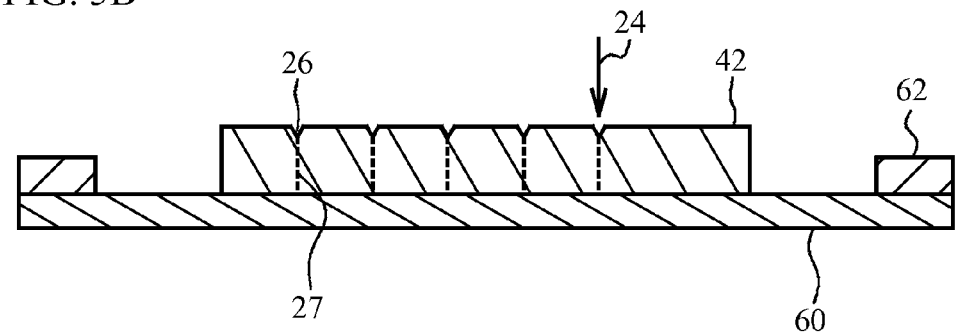

FIG. 5A and FIG. 5B are cross-sectional views illustrating the fabrication method of the acoustic wave device in accordance with the first embodiment. As illustrated in FIG. 5A, a bottom surface of the wafer 42 is bonded to a dicing tape 60, where the electrodes 14 and the metal layer 16 are formed on an upper surface of the wafer 42. The dicing tape 60 is held by a dicing ring 62. As illustrated in FIG. 5B, the piezoelectric substrate 10, which is the upper surface of the wafer 42, is irradiated with the laser beam 24. The laser beam 24 scans the wafer 42 along the dicing lines 22. The grooves 26 are formed in the upper surface of the wafer 42 by the irradiation of the laser beam 24. In addition, the irradiation of the laser beam 24 forms property changed regions 27, in which property of crystal inside the substrate is changed, in the piezoelectric substrate 10 and the sapphire substrate 12. It is sufficient if at least one of the groove 26 and the property changed region 27 is formed by the irradiation of the laser beam 24.

Figure 6A:
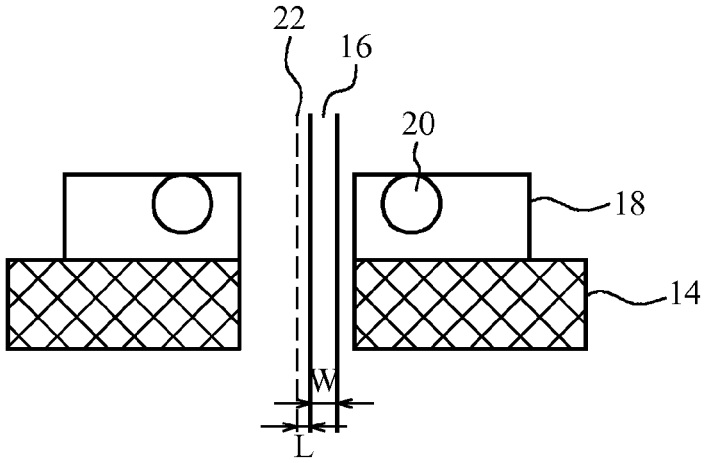
FIG. 6A and FIG. 6B are a plain view and a cross-sectional view, respectively, illustrating a fabrication process of the acoustic wave device in accordance with the first embodiment.
Figure 6B:
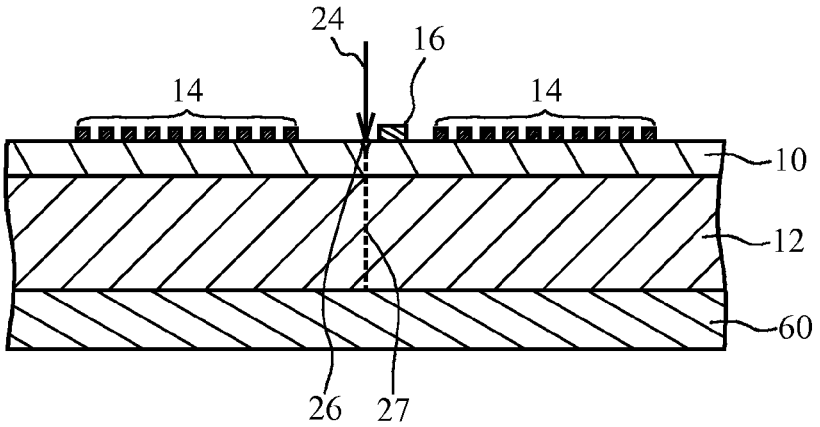

FIG. 6A and FIG. 6B are a plain view and a cross-sectional view, respectively, illustrating the fabrication process of the acoustic wave device in accordance with the first embodiment. As illustrated in FIG. 6A and FIG. 6B, the laser beam 24 scans the dicing lines 22 of the piezoelectric substrate 10 so that the metal layer 16 is not irradiated with the laser beam 24. A distance L from the metal layer 16 to the dicing line 22 is 10 μm to 50 μm for example. The distance L may be set within a range where the debris of the metal layer 16 is not formed and a distance between the regions 40 can be made small. A width W of the metal layer 16 is 5 μm to 20 μm for example. The width W can be set within a range where the damage of the electrodes 14 resulting from power collection is suppressed and the distance between the regions 40 can be made small. A green laser may be used for the laser beam 24, for example. A second harmonic of Nd:YAG laser may be used for the laser beam 24, for example. The grooves 26 and the property changed regions 27 can be formed in the piezoelectric substrate 10 efficiently by using a laser beam having a wavelength of around 500 nm. Other structures are the same as those illustrated in FIG. 1A and FIG. 1B, and a description is omitted.

Figure 7A:
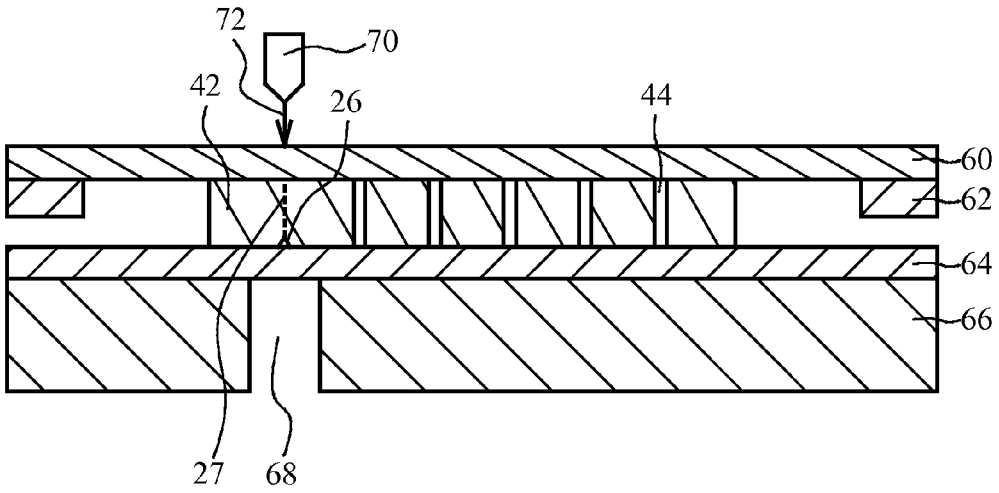
FIG. 7A and FIG. 7B are cross-sectional views illustrating the fabrication method of the acoustic wave device in accordance with the first embodiment.
Figure 7B:
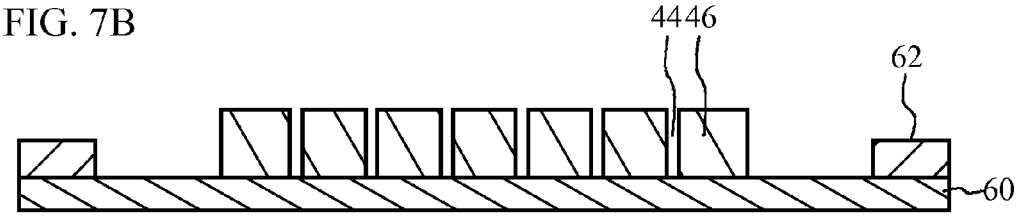

FIG. 7A and FIG. 7B are cross-sectional views illustrating the fabrication method of the acoustic wave device in accordance with the first embodiment. As illustrated in FIG. 7A, a surface protective sheet 64 is bonded to the upper surface of the wafer 42 (illustrated at a lower side in FIG. 7A). The dicing tape 60 is turned over, and the wafer 42 is placed on a supporting stage 66 having a groove 68 extending to the extension direction of the dicing line so that the surface protective sheet 64 is located downward. A break blade 70 is pressed on the dicing line 22 from a side of the bottom surface of the wafer 42 (illustrated at an upper side in FIG. 7A) as indicated by an arrow 72. This produces a crack 44 in the wafer 42 along at least one of the groove 26 and the property changed region 27. Referring to FIG. 7B, the wafer 42 is divided into individual acoustic wave chips 46 by forming the cracks 44 in the wafer 42 along the dicing lines 22 in a longitudinal direction and a lateral direction illustrated in FIG. 3A. As described above, the acoustic wave chips 46 are separated into individual ones along the dicing lines 22. Then, the separated acoustic wave chips 46 are picked up.

As illustrated in FIG. 4, the metal layer 16 is formed so as not to overlap with the dicing lines 22 in the first embodiment. As illustrated in FIG. 6A and FIG. 6B, the laser beam 24 scans the dicing lines 22 of the piezoelectric substrate 10 so that the metal layer 16 is not irradiated with the laser beam 24. As described above, the metal layer 16 is not irradiated with the laser beam 24, and thus it is possible to suppress the scattering of the conductive debris unlike FIG. 1B of the comparative example. The debris scatters less in the piezoelectric substrate 10 than in the metal layer 16. In addition, even if the debris scatters in the piezoelectric substrate 10, it is non-conductive, and has a small density. Therefore, it is possible to suppress short circuit between the electrodes 14 resulting from adherence of the debris on the electrodes 14, and to suppress a change in the frequency characteristic of the acoustic wave device caused by modulation of the acoustic wave. Furthermore, since the grooves 26 are formed in the piezoelectric substrate 10 without the metal layer 16, the grooves 26 can be formed deep. In addition, the property changed regions 27 are easily formed in the piezoelectric substrate 10 and the sapphire substrate 12. These prevent the piezoelectric substrate 10 from being hard to be cut along the dicing lines 22.

As illustrated in FIG. 3, the metal layer 16 preferably continuously extends to an edge portion of the piezoelectric substrate 10. This suppresses the damages of the electrodes 14 resulting from the piezoelectric effect during the fabrication process of the acoustic wave device. In addition, the metal layer 16 is preferably electrically connected to the back side of the wafer 42. This allows the electric charge generated by the piezoelectric effect to escape to the stage of the fabrication device.

Second Embodiment

Figure 8:
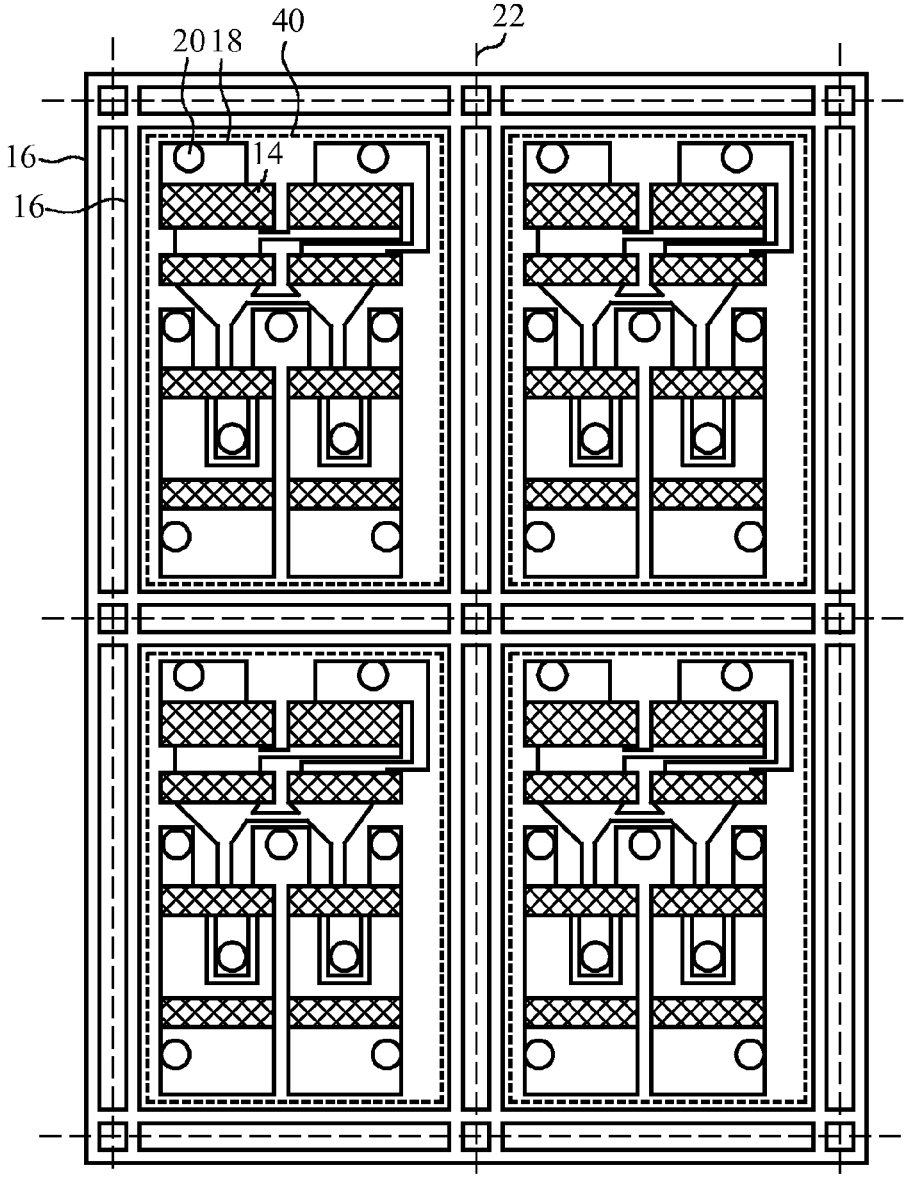
FIG. 8 is a plain view enlarging an upper surface of a wafer of a second embodiment.

A second embodiment forms the metal layer 16 at both sides of the dicing lines 22. FIG. 8 is a plain view enlarging an upper surface of a wafer of the second embodiment. As illustrated in FIG. 8, the metal layer 16 is formed so as to be located at both sides of the dicing lines 22. Other structures are the same as those illustrated in FIG. 4 of the first embodiment, and a description is omitted.

Figure 9A:
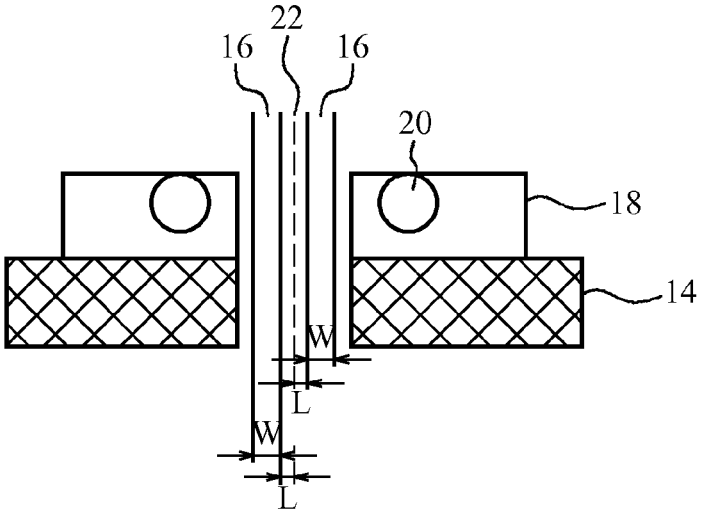
FIG. 9A and FIG. 9B are a plain view and a cross-sectional view, respectively, illustrating a fabrication process of an acoustic wave device in accordance with the second embodiment.
Figure 9B:
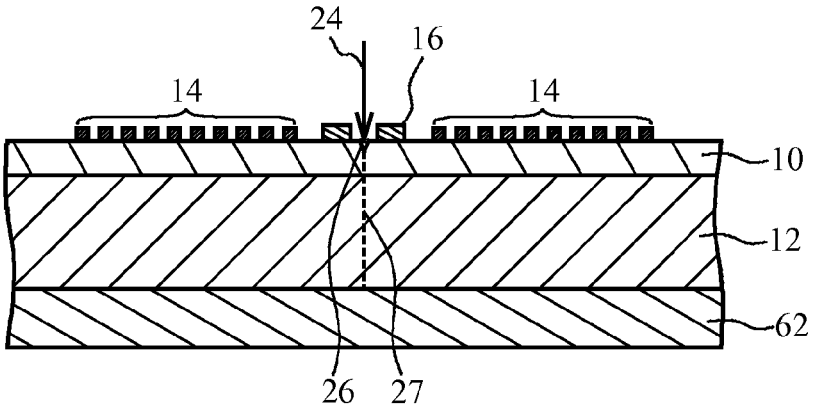

FIG. 9A and FIG. 9B are a plain view and a cross-sectional view, respectively, illustrating a fabrication process of an acoustic wave device in accordance with the second embodiment. As illustrated in FIG. 9A and FIG. 9B, a region sandwiched by the metal layer 16 is irradiated with the laser beam 24. The distance L from the metal layer 16 to the dicing line 22 is 10 μm to 50 μm for example. The distance L from the metal layer 16 at one side of the dicing line 22 to the dicing line 22 may be equal to or different from the distance L from the metal layer 16 at the other side of the dicing line 22 to the dicing line 22. The width W of the metal layer 16 is 5 μm to 20 μm for example. The metal layer 16 at one side of the dicing line 22 may have a width equal to or different from that of the metal layer 16 at the other side of the dicing line 22. Other structures are the same as those illustrated in FIG. 6A and FIG. 6B of the first embodiment, and a description is omitted.

The first embodiment forms the metal layer 16 at only one side of the dicing line 22. Thus, it is difficult to align the wafer 42 with a scan direction of the laser beam 24. On the contrary, as described in the second embodiment, when a first region of the metal layer 16 is formed at one side of the dicing line 22 and a second region of the metal layer 16 is formed at the other side of the dicing line 22, it becomes easy to align the wafer 42 with the scan direction of the laser beam 24. On the other hand, it is preferable to form the metal layer 16 at only one side of the dicing line 22 as described in the first embodiment in order to shorten the distance between the regions 40 in which the acoustic wave chips are formed. Furthermore, as described in the first and second embodiments, the metal layer 16 may have a straight line shape extending to the extension directions of the dicing lines 22. This enables to shorten the distance between the regions 40 in which the acoustic wave chips are formed. The metal layer 16 may have a straight line shape from the edge to edge of the wafer 42, or may have a straight line shape in a range of the region 40 in which a single acoustic wave chip is to be formed.

Third Embodiment

Figure 10:
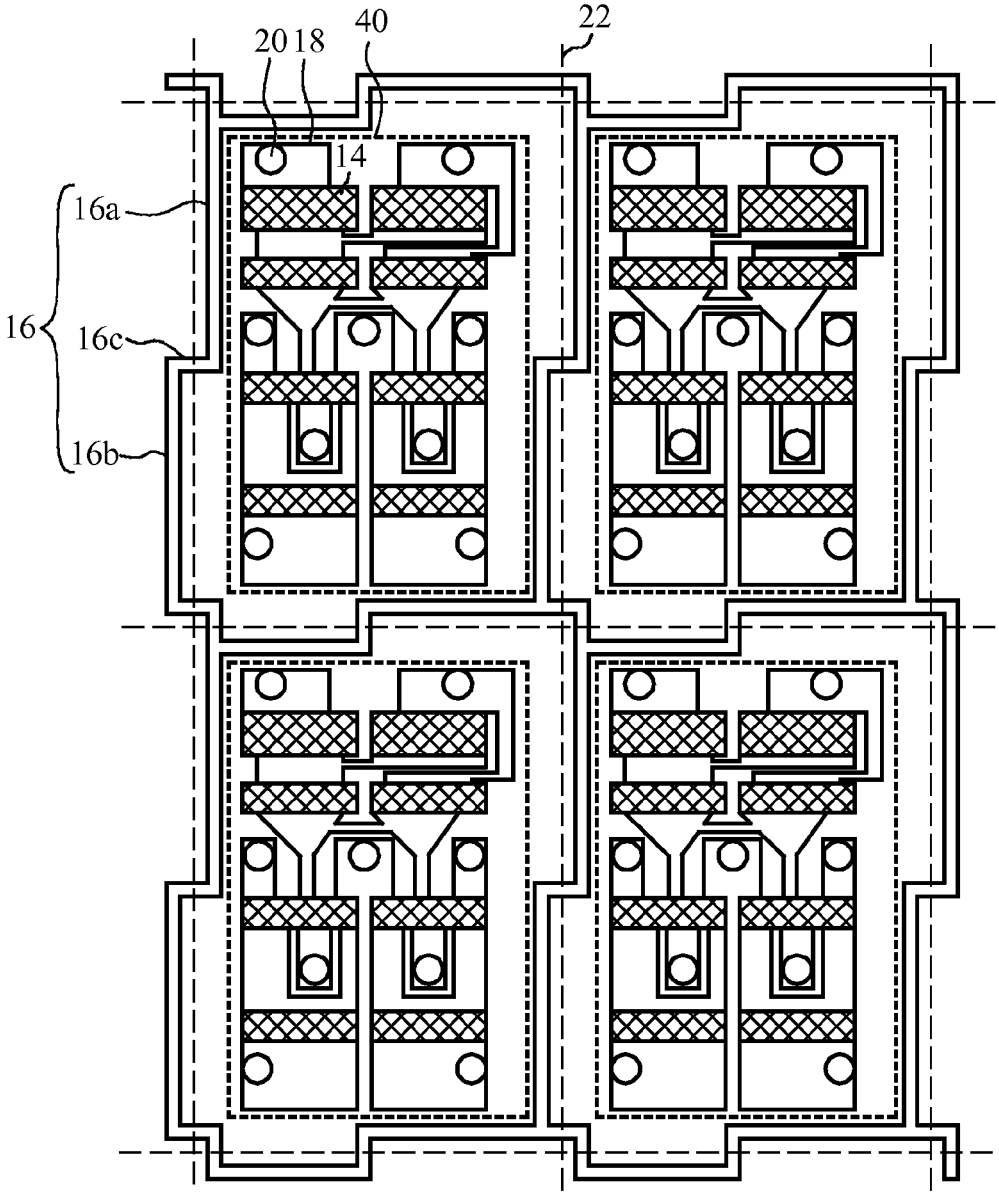
FIG. 10 is a plain view enlarging an upper surface of a wafer of a third embodiment.

A third embodiment forms the metal layer 16 in a zig-zag manner so that the metal layer 16 crosses the dicing lines. FIG. 10 is a plain view enlarging an upper surface of a wafer of the third embodiment. As illustrated in FIG. 10, the metal layer 16 includes first regions 16*a*, second regions 16*b* and third regions 16*c*. The first regions 16*a* are regions extending to the extension directions of the dicing lines 22 at one sides of the dicing lines 22. The second regions 16*b* are regions extending to the extension directions of the dicing lines 22 at the other sides of the dicing lines 22. The third regions 16*c* are regions connecting the first regions 16*a* and the second regions 16*b*. The respective widths of the metal layer 16 in the first regions 16*a* through the third regions 16*c* may be equal to each other or different from each other. Other structures are the same as those illustrated in FIG. 4 of the first embodiment, and a description is omitted.

As described in the third embodiment, it is sufficient if at least a part of the metal layer 16, i.e. the regions 16*a* and 16*b*, extends to the extension directions of the dicing lines 22. When the piezoelectric substrate 10 is irradiated with the laser beam 24, it is sufficient if the regions 16*a* and 16*b* extending to the extension directions of the dicing lines are not irradiated with the laser beam. As described in the third embodiment, even if the third regions 16*c* are irradiated with the laser beam 24, the regions irradiated with the laser beam 24 are a small portion of the whole region, the formation of the conductive debris is suppressed as well as the first and second embodiments.

As described in the third embodiment, the first regions and the second regions are located so that they do not overlap each other in their extension directions. This enables to form the metal layer 16 at both sides of the dicing lines 22 in a zig-zag manner. The third embodiment enables to align the wafer 42 with the scan direction of the laser beam 24 more easily than the second embodiment.

Fourth Embodiment

Figure 11:
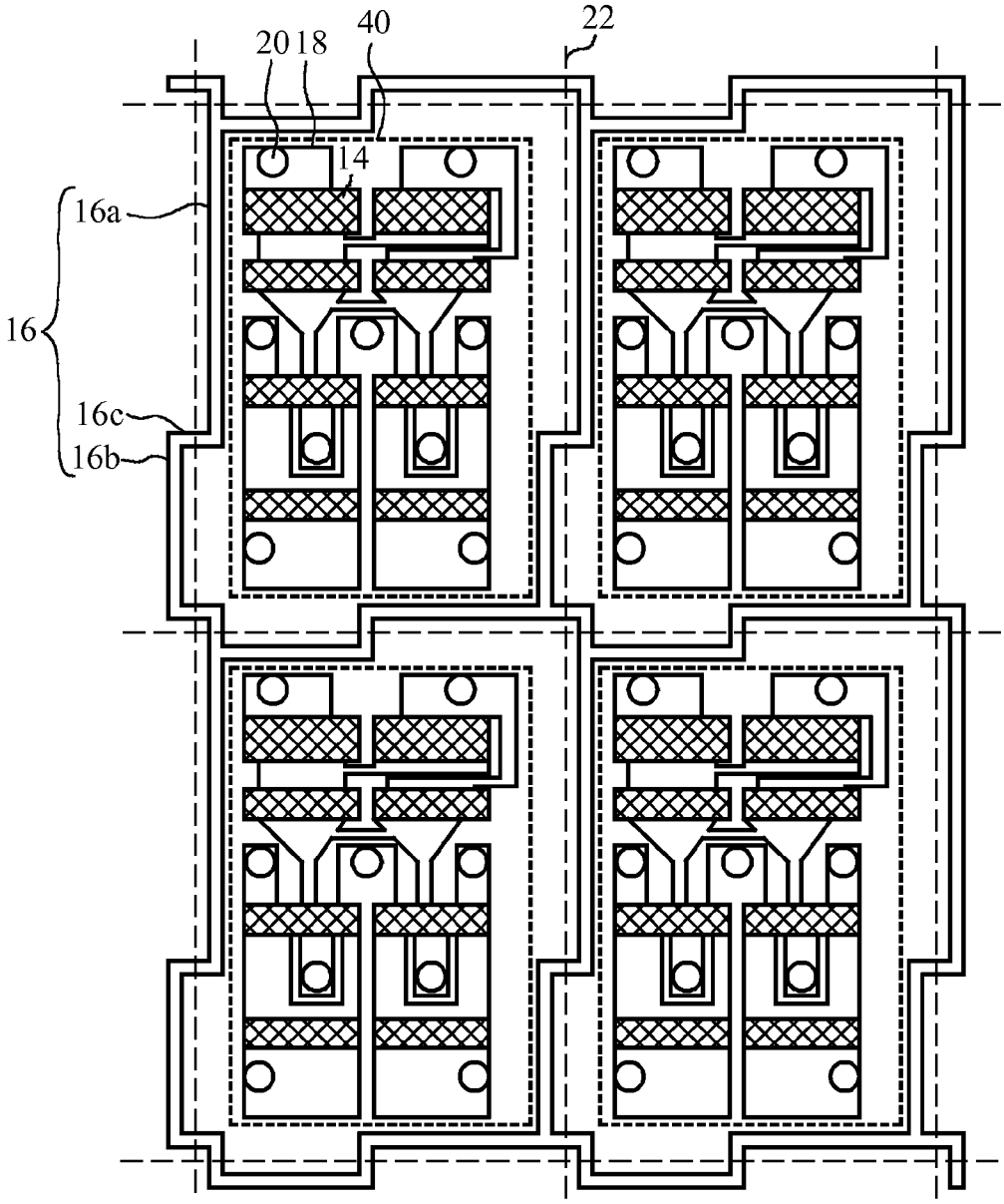
FIG. 11 is a plain view enlarging an upper surface of a wafer of a fourth embodiment.

A fourth embodiment does not provide the third regions 16*c* between the IDTs located in adjoining regions 40. FIG. 11 is a plain view enlarging an upper surface of a wafer of the fourth embodiment. As illustrated in FIG. 11, the third regions 16*c* are not located between the electrodes 14 (e.g. IDTs) located in the adjoining regions 40. Other structures are the same as those illustrated in FIG. 10 of the third embodiment, and a description is omitted.

The debris possibly scatters in areas adjacent to the third regions 16*c*. The fourth embodiment does not provide the third regions 16*c* between the IDTs, and thus suppresses the scattering of debris on the IDTs. In addition, when the conductive debris scatters on the bumps 20, the adhesiveness between the bumps 20 and an external device may deteriorate, or short circuit may occur between the bumps 20 or between the bumps 20 and the electrodes 14. Therefore, the third regions 16*c* are preferably not located between the bumps 20.

Fifth Embodiment

Figure 12:
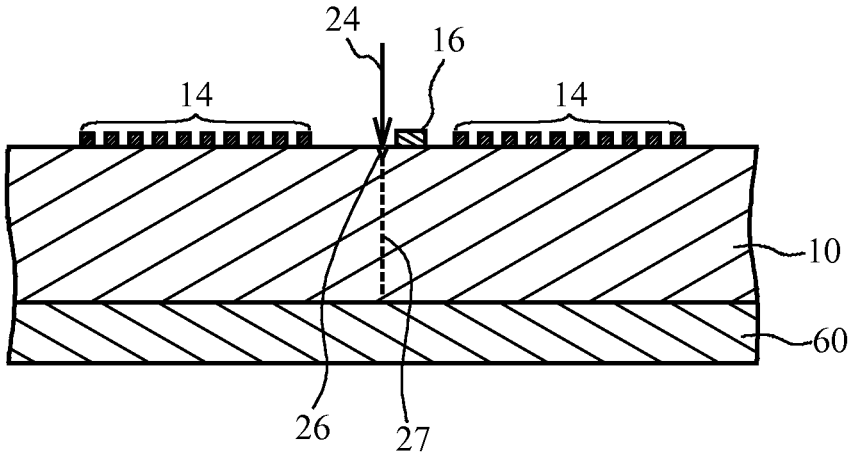
FIG. 12 is a cross-sectional view illustrating a fabrication process of an acoustic wave device in accordance with a fifth embodiment.

The fifth embodiment uses a piezoelectric substrate for a wafer. FIG. 12 is a cross-sectional view of a fabrication process of an acoustic wave device in accordance with the fifth embodiment. The sapphire substrate 12 is not provided to the wafer 42. Other structures are the same as those illustrated in FIG. 6B of the first embodiment, and a description is omitted.

As described in the first through fifth embodiments, it is sufficient if at least the piezoelectric substrate 10 is included in the wafer 42. The surface acoustic wave device is described as an example of the acoustic wave device, but the acoustic wave device may be a Love wave device or a boundary acoustic wave device.

The first through fifth embodiments form the metal layer 16 at all four sides of the regions 40 in which the acoustic wave chips are to be formed, but it is sufficient if the metal layer 16 is formed at least one side out of the four sides.

Although the embodiments of the present invention have been described in detail, it is to be understood that the various change, substitutions, and alterations could be made hereto without departing from the spirit and scope of the invention.

What is claimed is:

1. A fabrication method of an acoustic wave device comprising:

forming, on a piezoelectric substrate, a metal layer between adjacent regions among regions that are located on the piezoelectric substrate and are capable of forming acoustic wave chips respectively, the metal layer extending to an extension direction of a dicing line along which a laser beam is to be radiated for separating the acoustic wave chips, and in a plan view, at least a part of the metal layer not overlapping with at least a part of an area to be irradiated by said laser beam when said laser beam is radiated along the dicing line; and thereafter, scanning the dicing line of the piezoelectric substrate by said laser beam so that said at least a part of an area irradiated by the laser beam does not overlap with said at least a part of said metal layer in the plan view, the metal layer not being connected to an electrode of adjacent acoustic wave chips corresponding to the adjacent regions, wherein the metal layer includes a first region, which is located at one side of the dicing line and which does not overlap with said area is to be irradiated with the laser beam in the plan view, a second region, which is located at another side of the dicing line and which does not overlap with said area is to be irradiated with the laser beam in the plan view, and a third region connecting the first region to the second region through the dicing line.

2. The fabrication method of the acoustic wave device according to claim 1, wherein the metal layer continuously extends to an edge portion of the piezoelectric substrate.

3. The fabrication method of the acoustic wave device according to claim 1, wherein the first region and the second region are located so as not to overlap each other in perpendicular direction to the extension direction other than the third region.

4. The fabrication method of the acoustic wave device according to claim 1, wherein the third region is not located between IDTs formed on the piezoelectric substrate.

5. The fabrication method of the acoustic wave device according to claim 1, wherein each of the first region and the second region has a straight line shape.

6. The fabrication method of the acoustic wave device according to claim 1, further comprising:

separating the acoustic wave chips into individual ones along the dicing line.

7. The fabrication method of the acoustic wave device according to claim 1, wherein a portion of the metal layer other than the third region is not formed in an entire area in which the laser beam irradiated.

8. The fabrication method of the acoustic wave device according to claim 1, wherein forming the metal layer includes forming the metal layer so that the metal layer defines respective boundaries of said adjacent regions in the plan view.

9. The fabrication method of the acoustic wave device according to claim 1, wherein no portion of the metal layer other than the third region overlaps with said area to be irradiated with the laser beam in the plan view.

10. The fabrication method of the acoustic wave device according to claim 9, wherein the first region and the second region are located so as not to overlap each other in perpendicular direction to the extension direction other than the third region, the perpendicular direction being parallel to an upper surface of the piezoelectric substrate.

* * * * *